US005121715A

United States Patent [19]

Nogami et al.

[11] Patent Number: 5,121,715

[45] Date of Patent: Jun. 16, 1992

[54] COMPACT POWER SUPPLY

[75] Inventors: Eiji Nogami; Hironori Nakayama; Kazuhito Kitano, all of Iwata, Japan

[73] Assignee: Yamaha Hatsudoki Kabushiki Kaisha, Iwata, Japan

[21] Appl. No.: 683,599

[22] Filed: Apr. 9, 1991

[30] Foreign Application Priority Data

Apr. 13, 1990 [JP] Japan ..... 1-98141
Feb. 22, 1991 [JP] Japan ..... 3-50408

[51] Int. Cl.[5] ..... F01P 1/02

[52] U.S. Cl. ..... 123/41.7; 123/41.58; 123/198 E; 123/2; 181/204

[58] Field of Search ..... 123/41.56, 41.58, 41.59, 123/41.7, 2, 198 E, DIG. 12; 290/1 A, 1 B; 181/204

[56] References Cited

U.S. PATENT DOCUMENTS

| | | | |
|---|---|---|---|
| 4,141,334 | 2/1979 | Hatz et al. | 123/198 E |
| 4,385,678 | 5/1983 | Cederbaum | 181/204 |
| 4,608,946 | 9/1986 | Tanaka et al. | 123/2 |
| 4,702,201 | 10/1987 | Odo et al. | 123/2 |
| 4,835,405 | 5/1989 | Clancey et al. | 290/1 B |

*Primary Examiner*—Noah P. Kamen
*Attorney, Agent, or Firm*—Ernest A. Beutler

[57] ABSTRACT

A number of embodiments of air cooled compact power supplies having air inlet and air outlet openings in the lower portion of the housing of the power supply. The interior of the power supply is baffled so that the air flowing through it must follow a serpentine path to prevent air entrained foreign materials from impinging upon the engine.

25 Claims, 6 Drawing Sheets

COMPACT POWER SUPPLY

BACKGROUND OF THE INVENTION

This invention relates to a compact power supply and more particularly to an improved simplified cooling arrangement for a compact power supply that protects the components from foreign elements and particularly moisture.

The use of power supplies in which an internal combustion drives a generator to provide a source of electrical power is well known. Recently, there have been proposed a variety of very compact power supplies which are powered by small internal combustion engines and which are of such a size that they can be conveniently carried from place to place. One particularly successful form of power supply of this type employs an engine that is fueled by a gaseous pressurized fuel. As with any power supply, it is important to insure that the internal combustion engine and other components associated with the power supply are adequately cooled. This problem is particularly acute in conjunction with small portable power supplies because they may be placed in a wide variety of locations. Obviously, it is the practice to provide air duct openings in the outer housing of the power supply through which cooling air can flow. However; because of the wide variety of applications and locations where compact power supplies may be employed, there is a danger that water may enter through the air openings and damage the internal components.

It is, therefore, a principal object of this invention to provide an improved and simplified cooling arrangement for a compact power supply.

It is a further object of this invention to provide an air cooling arrangement for a compact power supply that will insure against the intrusion of foreign materials and particularly water on the mechanical components of the power supply.

Frequently this type of power supply is carried from place to place and is placed upon the ground in use. It has generally been the practice to provide a relatively low air inlet opening to the power supply for cooling air and an elevated air outlet opening. However, this type of flow arrangement does not offer as good a degree of cooling as may be desired and also can result in an unsightly case. Furthermore, the high outlet may be exposed so that water could be spilled into it. On the other hand, if both the inlet and outlet are positioned low, there is also the danger of water entry.

It is, therefore, a still further object of this invention to provide a compact power supply having air inlet and outlet openings that are positioned at a low level in the outer housing but wherein assurance is made that water cannot enter the device, or if it enters the device, it cannot reach the mechanical components thereof.

SUMMARY OF THE INVENTION

A first feature of this invention is adapted to be embodied in a portable power supply that comprises an outer housing defining an enclosed area in which an internal combustion engine is contained. The engine drives a generator for providing a source of electrical power. An air inlet opening is provided in the outer housing for admitting cooling air into the enclosed area and an air outlet opening is provided in the outer housing for discharging the air. In accordance with this feature of the invention, baffle means are provided in the enclosed area for redirecting the flow between the openings in a serpentine path within the enclosed area and to preclude air carried foreign material from contacting the engine.

Another feature of the invention is adapted to be embodied in a compact power supply that is comprised of an outer housing defining an enclosed area in which an internal combustion engine driving a generator is contained. In accordance with this feature of the invention, air inlet and air outlet openings are provided in the lower area of the outer housing for admitting and discharging cooling air. The enclosed area is provided with internal baffles that direct the air flow from the inlet opening to the outlet opening through a serpentine path so as to increase the length of air flow for cooling air and to assist in separation of foreign material from the air before it reaches the mechanical components.

DETAILED DESCRIPTION OF THE PREFERRED EMBODIMENTS

Figure 1:
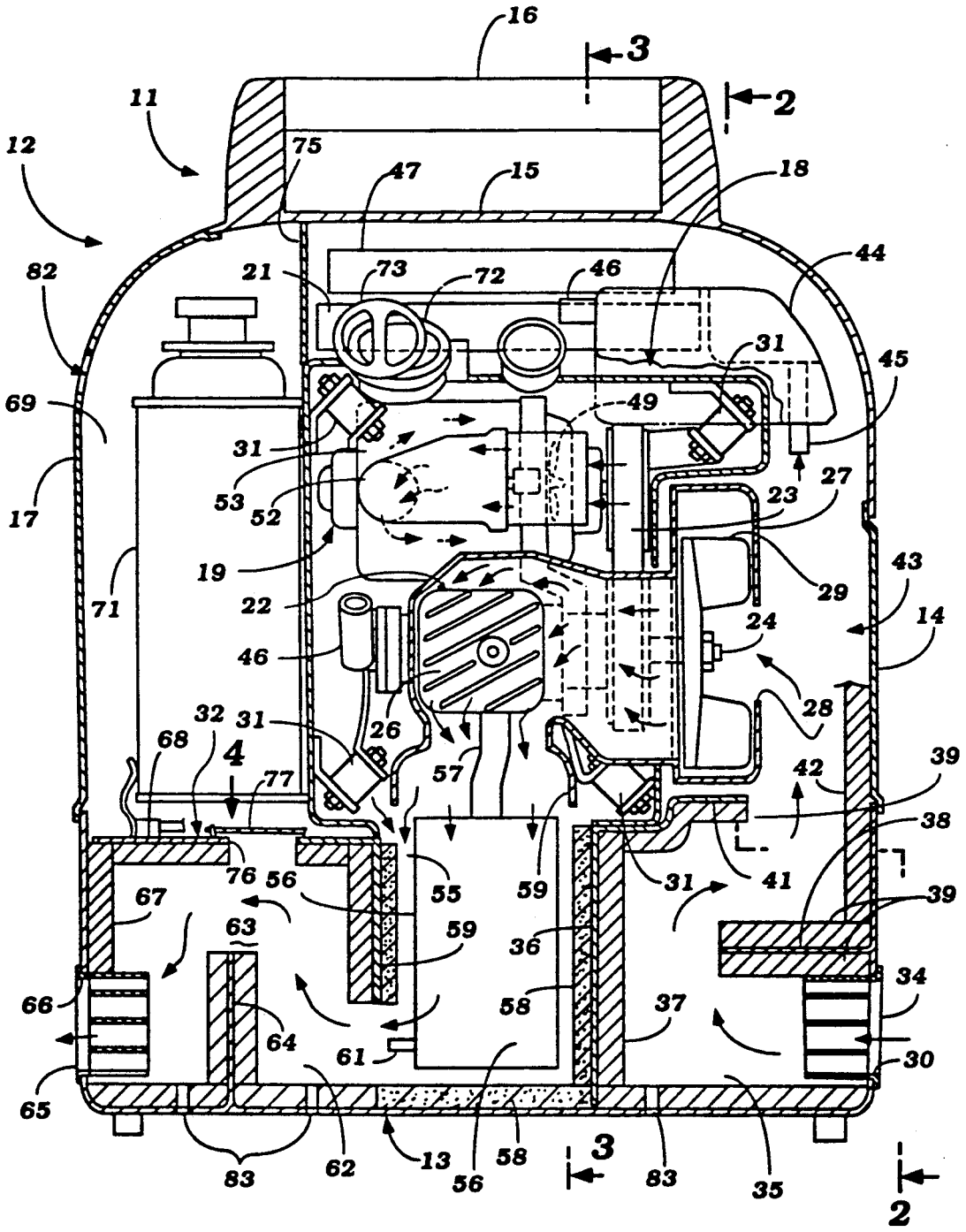
FIG. 1 is a cross sectional view taken through a power supply constructed in accordance with a first embodiment of the invention.
Figure 2:
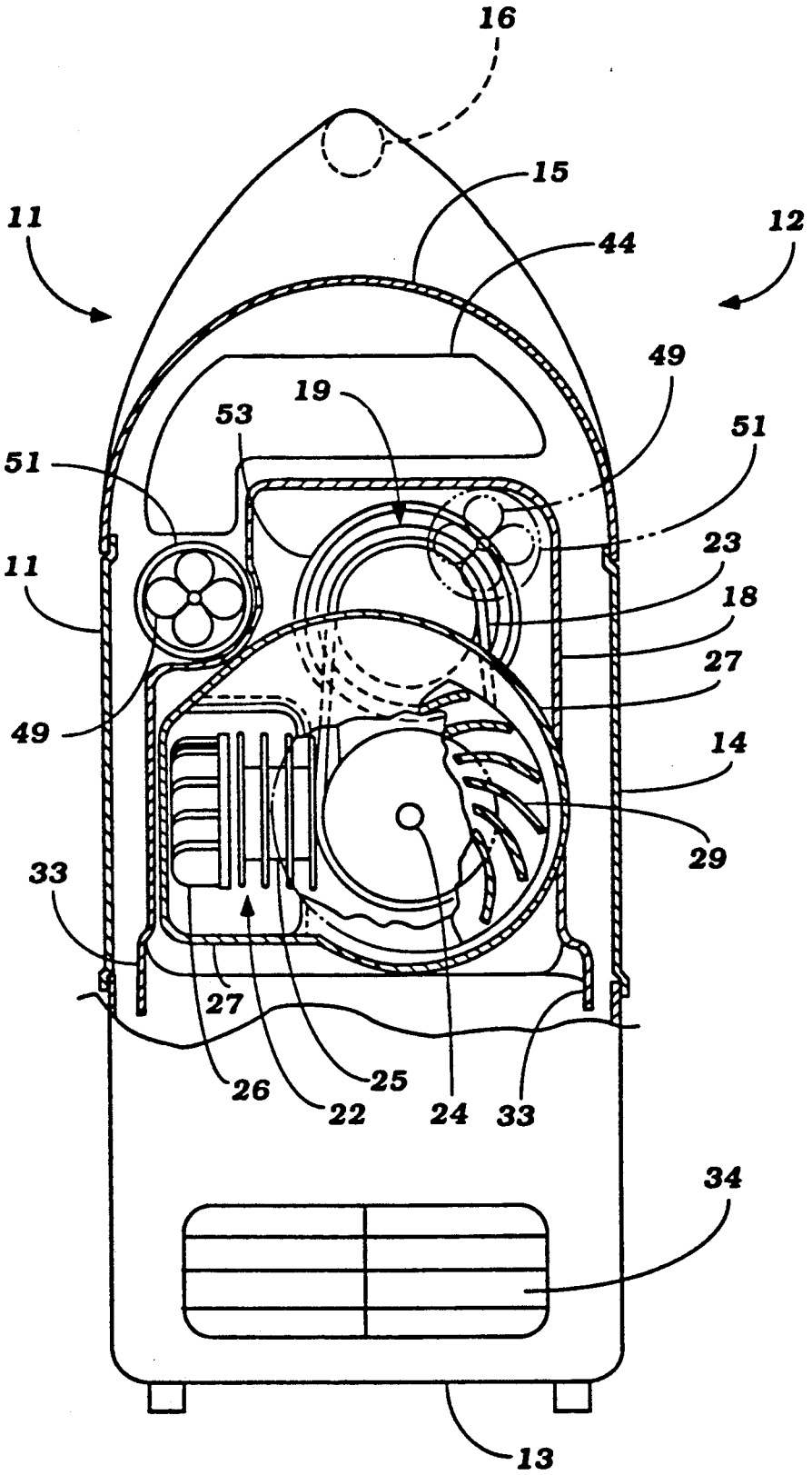
FIG. 2 is a cross sectional view of the power supply taken along the line 2—2 of FIG. 1.
Figure 3:
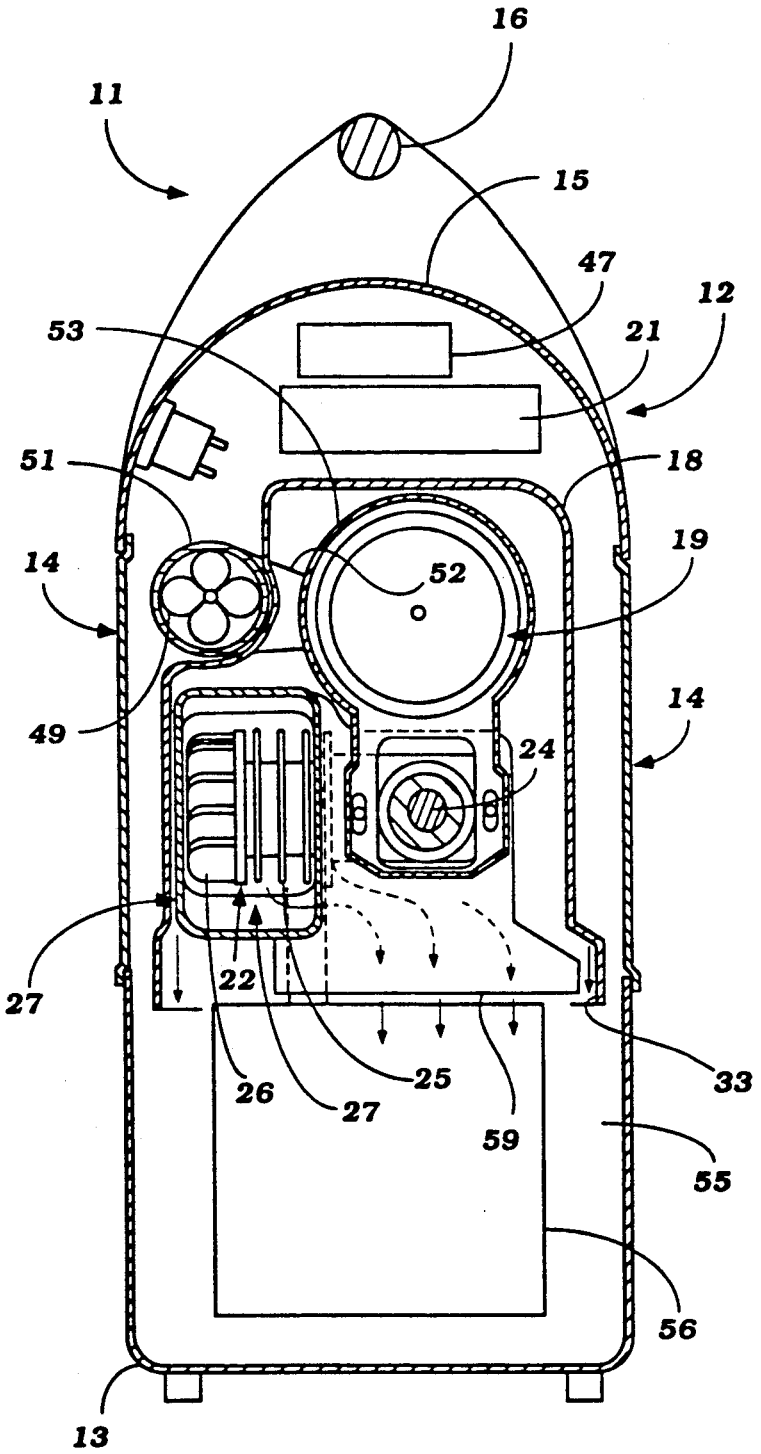
FIG. 3 is a cross sectional view taken along the line 3—3 of FIG. 1.
Figure 4:
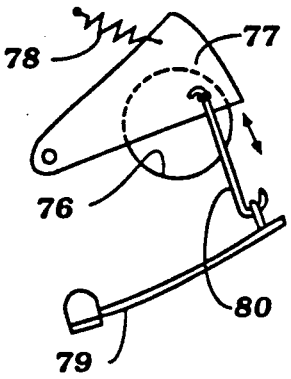
FIG. 4 is a view looking generally in the direction of the arrow 4 of FIG. 1 and shows the arrangement for controlling the temperature of the gaseous fuel supply.

Referring now in detail to the drawings and initially to the embodiment of FIGS. 1 through 5, a portable compact power supply constructed in accordance with this embodiment of the invention is identified generally by the reference numeral 11. The power supply 11 includes an outer housing assembly, indicated generally by the reference numeral 12 and which may be formed from a number of interconnected pieces of a suitable material, for example a molded plastic or the like.

Figure 5:
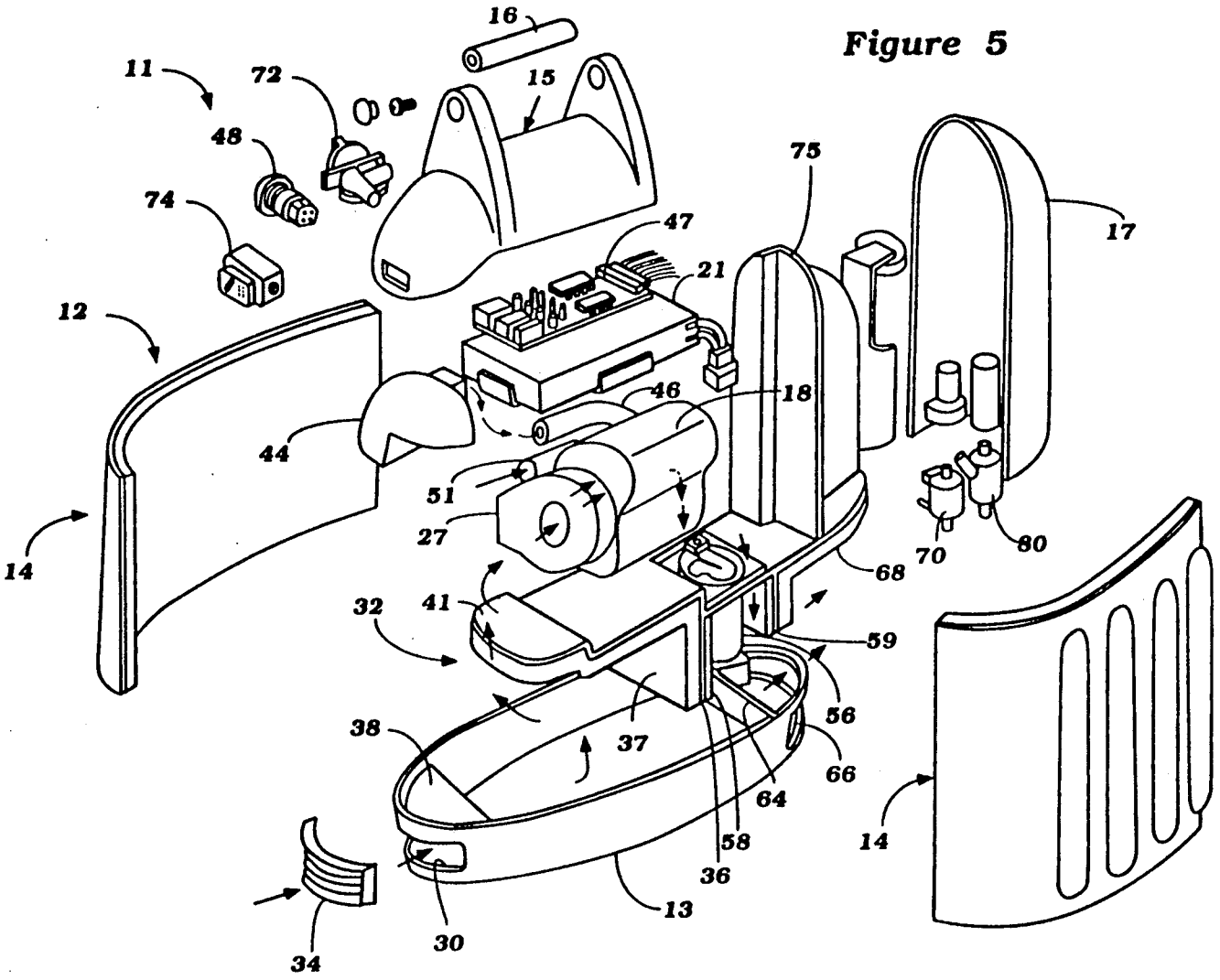
FIG. 5 is an exploded perspective view of this embodiment.

The housing assembly 12 has a generally box like configuration made up of components which may be best understood by reference to FIG. 5 and which are comprised of a cup shaped base 13 and a pair of interlocking side walls 14 that are affixed appropriately to the base 13 and which form the sides thereof. A cover piece 15 is affixed thereto and has a carrying handle 16 so that the power supply 11 may be easily carried from place to place. A removable closure 17 is fixed the base 13 and one end of the side walls 14 for access to the interior of the power supply 11 for a purpose to be described.

The outer housing 12 defines an enclosed space in which an inner case, indicated generally by the reference numeral 18 is positioned which inner case 18 is supported in a manner to be described. The inner case 18 may be formed from a plastic or metal and contains a combined starter generator 19 which is powered by or charges a battery 21 positioned above the upper wall of the inner case 18. The starter generator 19 is driven by an internal combustion engine 22 contained within the inner case 18.

The engine 22 is, in the illustrated embodiment, of the single cylinder air cooled type and operating on the two stroke principle. A driving belt 23 couples the crankshaft 24 of the engine 22 to the starter generator 19. The engine 22 has a horizontally disposed cylinder block 25 and cylinder head 26 which are appropriately finned for air cooling. The engine 22 is supplied with a gaseous form of fuel from a container, to be described, for its operation.

The inner case 18 is provided with its own internal shroud 27 which generally encircles the engine 22 and separates it from the starter generator 19 within the inner case 18. This internal shroud 27 has an air inlet opening 28 on one side which is in proximity to a cooling fan 29 of the centrifugal type which is affixed to the engine crankshaft 24 and directly driven by it.

The engine 22 and starter generator 19 as well as the inner shroud 27 are supported within the inner case 18 by means of a plurality of elastic isolators 31.

The inner case 18 is, in turn, supported on a base plate assembly, indicated generally by the reference numeral 32 and which is supported in the base 13 in an appropriate manner. The inner case 18 has lower flange portions 33 which engagably support the base plate 32. The base plate 32 is formed from a plurality of interconnected pieces and as may be seen in FIGS. 1 and 5 provide a number of spaced apart compartments within the lower part of the housing 18. An air inlet opening, indicated generally by the reference numeral 34 is provided in a cut out 30 formed at one side of the base assembly as thus far described and introduces air into an inlet cavity 35. The inlet opening 34 is confronted by a vertically extending baffle formed by an upstanding wall 36 of the base 13 and to which an inner wall member 37 is affixed.

In addition, the base 13 has a horizontally extending wall or baffle 38 positioned above the inlet opening 34 and which also has affixed to it insulating members 39. As a result, the baffles 38 and 36 and their related insulating members 37 and 39 define a circuitous path through the inlet portion 35 wherein the air flow is turned from a horizontal direction to a vertical direction and then back to a horizontal direction as shown by the arrows in FIG. 1.

The horizontally flowing air, which has now been turned through 180° after having passed through the inlet opening 34 then passes through a vertically positioned opening 39 formed by a portion 41 of the base 32 and an upstanding insulating member 42 fixed to the inner portion of the case 12. This air then enters a chamber 43 in proximity to the engine driven fan 29. In fact, the fan 29 will cause a negative pressure to be established that will assist in drawing air through the inlet opening 34. A portion of the air will then be circulated through the inner case 18 around the engine 22 for its cooling as may be shown by the arrows in the figures.

An air cleaner 44 for the engine 22 is positioned above the inner case 18 and has a downwardly facing inlet opening 45 that draws air from the chamber 43. This air is then delivered to the induction system of the engine through a conduit 46. In this way, the engine 22 will receive relatively clean air due to the circuitous path caused by the baffling as aforedescribed. In addition, a filter element, not shown, may be positioned within the air cleaner 44 for further purifying the air.

The area above the inner case 18, in addition to containing the battery 21 and air cleaner 44 also includes a control and regulating circuit 47 for regulating the charge on the battery 21 from the engine 22 and also so as to permit operation of the starter generator 19 as a starter during starting operation. An externally accessible starter switch 48 (FIG. 5) is provided for actuating the starter circuit to initiate operation of the power supply 11.

In addition to the engine driven cooling fan 29, there may be further provided a supplemental cooling fan, indicated generally by the reference numeral 49 and which is driven by a small electric motor powered from the battery 21. In the embodiment shown in solid line views in FIGS. 1 through 5, the fan 49 is contained within a separate shroud 51 that is positioned externally of the inner case 18 and which draws air through a forwardly facing inlet opening from the chamber 43. This fan then delivers cooling air through a duct 52 to a housing 53 which encircles the starter generator 19 for its cooling. This air is then discharged into the interior of the inner case 18 for discharge downwardly in a manner later to be described. In addition, a further cooling fan 52 is positioned internally of the inner case 18 as shown by the phantom line view in FIG. 2 for cooling the other components in the inner case 18.

It has been previously noted that the inner case 18 has a skirt portion 33 which faces downwardly. This downwardly facing skirt portion 33 communicates with a further chamber 55 that is formed within the base 13 to the rear of the inlet chamber 35. A vertically disposed muffler 56 which receives exhaust gases from the engine 22 through an exhaust pipe 57 is positioned within this inner chamber and is insulated by means of a combined glass wool foil covered insulating material 58 that is positioned on the backside of the baffle 36 and on the upper surface of the central portion of the base. In addition, a further baffle 59 of the base plate 32 defines the rearward periphery of this chamber 55 in which the muffler 56 is positioned. The engine inner shroud 27 further has a downwardly facing discharge opening 59 which also communicates with the chamber 55. The muffler 56 has an tailpipe 61 that discharges through an opening 62 formed by the baffle 59 and which defines an exhaust air chamber 63.

A further baffle 64 of the base 13 extends into the chamber 63 and separates the opening 62 from an exhaust air opening 65 formed in the outer case and which is inserted into a cut out 66 formed therein. An insulating wall 67 and horizontal wall 68 of the base 32 complete the definition of the exhaust air chamber 63.

As may be seen in FIG. 1, the air must flow through a circuitous path to exit from the housing air exit opening 65. In addition, the baffles form a circuitous path through which any air must pass when the unit is not operating before it can reach the mechanical components contained within the inner case 18. As a result, it will be insured that foreign material cannot reach the engine even when the engine is not operating and regardless of the direction of air flow between the inlet 34 and outlet 65. That is, this baffling is effective either during normal air flow or should reverse air flow occur for any reason.

In the outer casing 12 above the air outlet chamber 63, there is provided a fuel chamber 69 in which a pressurized container 71 containing a gaseous fuel that has been pressurized to a liquid state is contained. A suitable receptacle, not shown, connects the gaseous fuel source 71 with the engine 22 and specifically its induction system. A gas control valve 72 (FIGS. 1 and 5) is provided at the top of the outer housing 12 and is controlled by a knob 73 for turning the gaseous fuel on and off to stop the engine and supply of electrical power. A receptacle 74 is accessible at the top of the housing and specifically its cover portion 15 so that a user may plug in an electrically powered device to be operated by the power supply 11.

It should be understood that the arrangement for controlling the starting and stopping of the unit including the starter switch 48 and gas control valve 72 as well as the control circuit 47 may be of any suitable type.

The fuel supply chamber 69 is separated from the central portion wherein the battery 21 and control circuit 47 are provided by means of a vertical baffle wall 75. In addition, various other control devices may be contained within the outer housing including a solenoid valve 70 (FIG. 5) for controlling the amount of fuel supplied to the engine and also a control valve 80 for controlling the gas flow to the engine and its speed, much like a governor mechanism. This mechanism forms no part of the invention, since the invention is directed primarily toward the air flow arrangement through the outer housing for cooling the components and for insuring that foreign material will not enter the engine 22 or impinge upon the starter generator 19.

Under low temperature it may be desirable to provide some heat to the fuel in the container 71. There is provided an vertical air flow opening 76 in the base 32 between the chamber 63 and the chamber 69. A thermostatically operated valve shown in FIG. 4 controls the flow through the opening 76. This valve includes a valve shutter 77 that is biased to an open position by a coil compression spring 78. A thermostatic spring 79 is connected also to the valve 77 by a link 81. The mechanism is such that when the air is cold in the chamber 69, the shutter valve 77 will be in an open position so that heated air from the exhaust of the engine and will be delivered vertically to heat the container 71. This air exits the chamber 69 through an opening 82. However, as the container becomes heated, the thermostatic spring 79 will deflect and draw the valve plate 77 against the spring 78 to close the opening 76 and prevent overheating.

It has been previously noted that the baffling within the outer housing 12 causes a circuitous air flow through the device and also prevents water from flowing into the mechanical components. In fact, this serpentine or circuitous air flow will cause water separation. The water which is separated will tend to fall into the intake air chamber 35 or the exhaust air chamber 63. Drain holes 83 are formed in the base 13 so as to permit this condensed water to escape.

Figure 6:
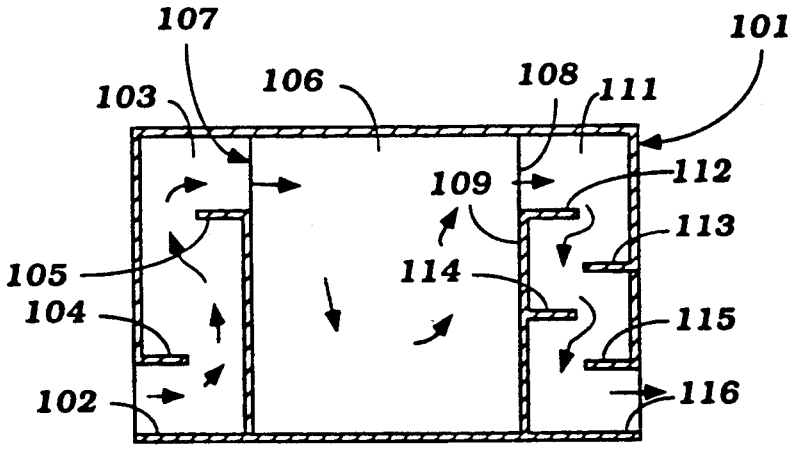
FIG. 6 is a partially schematic view showing the air flow through the housing of a second embodiment of the invention.

FIG. 6 shows another embodiment of the invention which is generally similar to the embodiment of FIG. 1, however, there is a slightly different flow path through the interior of the outer housing in this embodiment. Because of its general similarity to the embodiment of FIGS. 1 through 5, none of the internal components have been shown in this embodiment. Only the cross section through the case and the flow pattern have been illustrated.

In this embodiment, the outer housing, indicated generally by the reference numeral 101 has an air inlet opening 102 formed at its lower side that defines an air entrance cavity 103. A pair of baffles 104 and 105 extend into the air inlet cavity 103 so as to cause a serpentine air flow therethrough before exit into the central engine and other equipment compartment 106 through an outlet passage 107 formed at an upper area thereof. The air then flows around the starter generator and engine in a circuitous path direction as shown by the arrows in FIG. 6 and exits through an exit opening 108 formed in a vertically extending wall 109 which defines in part an exit air chamber 111.

The air flows down through the exit air chamber 111 past a plurality of baffles 112, 113, 114 and 115 on opposing side walls thereof to direct the air in a serpentine pattern as shown by the arrows in FIG. 6. The air then exits through an exit opening 116 formed in the lower portion of the outer housing 101. Thus, like the preceding embodiment, the air flow is turned several times before it reaches the compartment in which the engine and starter generator are located so that any water or foreign particles will be extracted from the air before it reaches the engine and starter generator. This is also true even if reverse flow occurs. The separated water is removed through drains, not shown, as in the embodiment of FIGS. 1 through 5.

Figure 7:
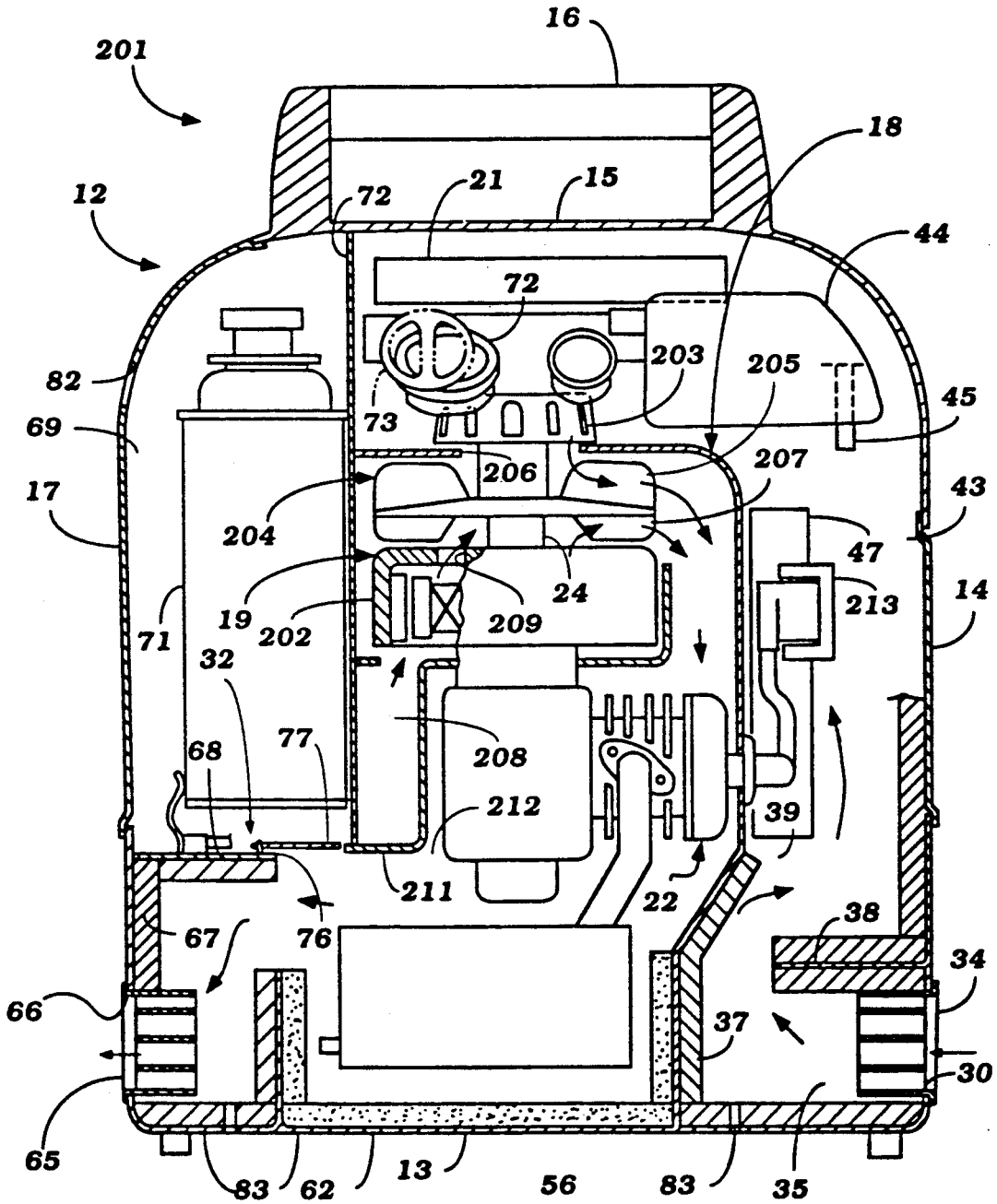
FIG. 7 is a cross sectional view, in part similar to FIG. 1, and shows another embodiment of the invention.

A compact portable power supply constructed in accordance with a third embodiment of the invention is illustrated in cross section in FIG. 7 and is identified generally by the reference numeral 201. The power supply 201 is basically the same, except as will be hereinafter noted, as the embodiment of FIGS. 1 through 5. For that reason, components which are the same or substantially the same have been identified by the same reference numeral and only the differences between this embodiment and the embodiment of FIGS. 1 through 5 will be discussed.

In this embodiment, the control circuit 47 is positioned to extend vertically in the chamber 43 so that it will receive a source of cool air flowing upwardly from the opening 39 after having passed the baffles 37 and 38. The air then flows vertically upwardly past the air inlet device 44 and flows horizontally across the chamber formed vertically above the inner casing 18.

In this embodiment, the generator 19 is only a generator and not a starter generator. The generator 19 has a flywheel 202 that carries permanent magnets that cooperate with coils that are fixed in a stationary manner within the inner casing 18 for generating electricity. The flywheel 202 is directly coupled to the engine crankshaft 24 which crankshaft extends vertically upwardly through an opening in the inner casing 18 which faces upwardly. A recoil type starter 203 is affixed to the upper end of the crankshaft 24 for pull starting of the engine 22 since the generator 19 does not also act as a starter.

A fan, indicated generally by the reference numeral 204 is affixed to the crankshaft 24 between the flywheel 19 and the recoil starter 203 and has an upper series of fan blades 205 which act to draw air downwardly from the area above the inner casing 18 through an air entry opening 206. This air is then discharged downwardly across the engine for its cooling.

The fan 204 has a further lower series of fan blades 207 which act to draw air from a chamber 208 formed internally within the casing 18 and which may be open through a suitable duct (not shown) to the chamber 43. This air is drawn upwardly across the generator 19 to cool it passing through openings 209 in the flywheel 202. This air is then discharged downwardly across the engine 22 for its cooling.

A lower wall 211 of the inner casing defines an air outlet opening 212 which is positioned in proximity to the muffler 56, which in this embodiment extends horizontally, for its cooling. The cooling air then exits in the same path as in the previously described embodiment.

In this embodiment, an ignition coil 213 for firing the spark plug of the engine is also carried by the control circuit 47 and is positioned in the air entrance passageway 43 for its cooling.

It should be readily apparent from the foregoing description that the described embodiments of the invention are very effective in providing a small compact power supply which is air cooled and in which the air inlet and outlet openings are formed in the lower portion of the housing but internal baffling precludes foreign material from entering onto the mechanical components such as the engine and generator regardless of the air flow direction through the inner housing. Although three embodiments of the invention have been illustrated and described, various changes and modifications may be made without departing from the spirit and scope of the invention, as defined by the appended claims.

We claim:

1. A portable power supply comprising an outer housing defining an enclosed area, an internal combustion engine contained within said enclosed area and driving a generator for providing a source of electrical power, an air inlet opening in said outer housing for admitting cooling air into said enclosed area, an air outlet opening in said outer housing for discharging air therefrom, and baffle means in said enclosed area for redirecting the flow between said openings in a serpentine path within said enclosed area to preclude air carried foreign material from directly impacting of said engine, said baffle means including means for causing the air flowing through said air inlet opening to be redirected through at least three right angle turns before passing across said engine.

2. A portable power supply as set forth in claim 1 wherein at least one of the air openings is formed in the bottom of the outer housing.

3. A portable power supply as set forth in claim 2 wherein both of the air openings are formed in the bottom of the housing.

4. A portable power supply as set forth in claim 1 wherein the baffle means include at least one baffle extending in confronting relationship to the inlet opening.

5. A portable power supply as set forth in claim 1 wherein the baffle means includes at least one baffle extending in confronting relationship to the outlet opening.

6. A portable power supply as set forth in claim 5 further including at least one baffle formed in confronting relationship to the inlet opening.

7. A portable power supply as set forth in claim 6 wherein at least one of the air openings is formed in the bottom of the outer housing.

8. A portable power supply as set forth in claim 7 wherein both of the air openings are formed in the bottom of the housing.

9. A portable power supply comprising an outer housing defining an enclosed area, an internal combustion engine contained within said enclosed area and driving a generator for providing a source of electrical power, an air inlet opening in said outer housing for admitting cooling air into said enclosed area, an air outlet opening in said outer housing for discharging air therefrom, and baffle means in said enclosed area for redirecting the flow between said openings in a serpentine path within said enclosed area to preclude air carried foreign material from compacting said engine, said engine being positioned in a central area of said outer housing and said inlet opening is on one side of said housing so that the air must flow around said engine on the path from said inlet opening to said outlet opening, said engine being powered by a pressurized source of gaseous fuel contained within a fuel container positioned within said outer housing, said fuel container being positioned on the exit side of said outer housing, thermostatically controlled valve means for permitting a portion of the heated air flowing toward said air outlet opening to be diverted to heat said fuel container.

10. A portable power supply as set forth in claim 9 wherein the baffle means include at least one baffle extending in confronting relationship to the inlet opening.

11. A portable power supply as set forth in claim 9 wherein the baffle means includes at least one baffle extending in confronting relationship to the outlet opening.

12. A portable power supply as set forth in claim 11 further including at least one baffle formed in confronting relationship to the inlet opening.

13. A portable power supply as set forth in claim 9 further including a muffler for silencing the exhaust gases from the engine contained within the enclosed area and in the path of air flow from the inlet opening to the outlet opening.

14. A portable power supply as set forth in claim 13 wherein the muffler is disposed downstream of the engine in the air flow path.

15. A portable power supply comprising an outer housing defining an enclosed area, an internal combustion engine contained within said enclosed area and driving a generator for providing a source of electrical power, an air inlet opening in a lower portion of said outer housing for admitting cooling air into said enclosed area, an air outlet opening formed in a lower portion of said outer housing for discharging air therefrom, said engine being powered by a pressurized source of gaseous fuel contained within a fuel container positioned within said outer housing, said fuel container being positioned on the exit side of said outer housing, and thermostatically controlled valve means for permitting a portion of the heated air flowing toward said air outlet opening to be diverted to heat said fuel container.

16. A portable power supply as set forth in claim 15 further including at least one baffle extending in confronting relationship to the inlet opening.

17. A portable power supply as set forth in claim 15 further including at least one baffle extending in confronting relationship to the outlet opening.

18. A portable power supply as set forth in claim 17 further including at least one baffle formed in confronting relationship to the inlet opening.

19. A portable power supply as set forth in claim 15 wherein the engine is provided in a central area of the outer housing and the inlet opening is on one side of the housing and the outlet opening is on the other side of the housing so that the air must flow around the engine compartment on the path from the inlet opening to the outlet opening.

20. A portable power supply as set forth in claim 19 further including at least one baffle extending in confronting relationship to the inlet opening.

21. A portable power supply as set forth in claim 19 further including at least one baffle extending in confronting relationship to the outlet opening.

22. A portable power supply as set forth in claim 21 further including at least one baffle formed in confronting relationship to the inlet opening.

23. A portable power supply as set forth in claim 15 further including a muffler for silencing the exhaust gases from the engine contained within the enclosed area and in the path of air flow from the inlet opening to the outlet opening.

24. A portable power supply as set forth in claim 23 wherein the muffler is disposed downstream of the engine in the air flow path.

25. A portable power supply comprising an outer housing defining an enclosed area, an internal combustion engine contained within said enclosed area and driving a generator for providing a source of electrical power, an air inlet opening in said outer housing for admitting cooling air into said enclosed area, an air outlet opening in said outer housing for discharging air therefrom, said internal combustion engine having an exhaust system discharging exhaust gases into said outer housing between said air inlet opening and said air outlet opening, and baffle means in said enclosed area for redirected the flow of air between said openings in a serpentine path within said enclosed area and for effecting turning of the exhaust gases flowing from said exhaust system through at least three right angles before exit through said air outlet opening.

* * * * *